US005584606A

United States Patent [19]

Hoogasian, Jr.

[11] Patent Number: 5,584,606

[45] Date of Patent: Dec. 17, 1996

[54] ADJUSTABLE DOCK SUPPORT APPARATUS AND METHOD

[76] Inventor: Donald J. Hoogasian, Jr., 5 Nipmuc Rd., Paxton, Mass. 01612

[21] Appl. No.: 534,722

[22] Filed: Sep. 27, 1995

[51] Int. Cl.[6] ..... E02B 3/20

[52] U.S. Cl. ..... 405/221; 405/218

[58] Field of Search ..... 405/218–221, 405/3–7, 196; 114/44, 48, 45, 50–53, 258, 263; 182/146, 141, 222, 223; 248/423

[56] References Cited

U.S. PATENT DOCUMENTS

| | | | |
|---|---|---|---|
| 3,169,644 | 2/1965 | Godbersen | 405/3 X |
| 3,208,227 | 9/1965 | Armbrust | 405/221 |
| 4,349,297 | 9/1982 | Misener | 405/218 X |
| 4,948,300 | 8/1990 | Bateson | 405/220 |
| 5,000,620 | 3/1991 | Bonnema et al. | 182/146 X |
| 5,106,237 | 4/1992 | Meldrum | 405/221 |

FOREIGN PATENT DOCUMENTS

| | | | |
|---|---|---|---|
| 1330240 | 8/1987 | U.S.S.R. | 405/221 |

*Primary Examiner*—Dennis L. Taylor
*Attorney, Agent, or Firm*—James F. Baird

[57] ABSTRACT

Method and dock support installation and apparatus that permits easy, quick adjustments for variations in depth to insure a uniformly level and stable dock, at a desired height above the water surface of a lake or pond. An outer tube is slideably positioned and secured to an adjustment tube by means of a plurality of lock bolts that are screwed within helicoils that are positioned within lock bolt sleeves. The lock bolt sleeves are fixedly secured to the outer surface of the outer tube. A plurality of support tubes are slideably positioned and secured to the adjustment tube by means of a plurality of extenders and a plurality of bolts. The outer tube has a contact plate to secure the apparatus to the dock. The most bottom support tube slides over and is secured by means of a bolt to a tube stub positioned on a base plate that rests on the bottom surface of the pond or lake. A safety support clamp may be also used to prevent the unit from compressing and collapsing under extreme weight conditions. All materials are made of corrosion resistant materials.

4 Claims, 3 Drawing Sheets

ADJUSTABLE DOCK SUPPORT APPARATUS AND METHOD

BACKGROUND OF THE INVENTION

This invention relates to an apparatus and method to easily install and adjust a dock at a lake or pond.

When a dock is installed at a lake or pond it is always very frustrating to insure that the dock will be easy to install and remain level and stable. The problem is sometimes resolved through the use of a compromise as to either the docks being stable or uniformly and consistently level. The material used for the supports is very important. Many of the prior art rely on wooden supports such as U.S. Pat. No. 5,172,881. The problem with wood is that it will rot and deteriorate with time. Also wood tends to swell and become extremely heavy and difficult to handle after it has been in the water for a season. In addition the wood becomes slippery. U.S. Pat. No. 5,156,493 shows a very complicated approach to secure the post to the dock without the ability to adjust for changes in water level or variations in the water bottom. Another alternative would be the use of metal posts. A truly adjustable jack mechanism that is made of metal is disclosed in U.S. Pat. No. 5,165,665, however it would be adjustable only over a limited range and is not practical for use in water to support a dock due to the complex component pans and likelihood of rusting in position.

The short coming of most materials is that they either rust, rot or deteriorate in some manner. Where material is used that will not deteriorate rapidly such as pressure treated wood there are environmental concerns.

These prior solutions fail to fully address the problem of providing an apparatus in order that the dock may be easily installed as a level and stable unit and remain so. These solutions provide a means that gives support but fails to provide a means for easy adjustment. My invention specifically deals with a support that is easily adjustable and will insure that the dock will remain level and stable.

It is therefore an object of the invention to provide an apparatus and method for supporting a docket that is both easy to install and easy to adjust.

Another object of the invention is to provide an apparatus and method for easily installing a dock in order that the dock will be stable.

A further object of the invention is to reduce the time required to install a dock.

With these and other objects in view, as will be apparent to those skilled in the art, the invention resides in the combination of parts set forth in the specification and covered by the claims appended hereto.

SUMMARY OF THE INVENTION

The field of my invention is the installation and support for water front docks at lakes or ponds. My invention involves a support apparatus and method in order to quickly and easily install and support a dock at a lake or pond.

I have discovered an invention that makes use of a series of tubes that slide within each other to telescope. An outer tube has a contact end, a support end, an outer surface and an inner diameter surface. The outer tube contact end is sized and shaped for the application of bolts to secure the invention to a member of a dock frame. The outer tube has a plurality of openings, a plurality of lock bolt sleeves having a threaded inner diameter surface forming an opening and an outer surface are fixedly attached to the outer surface of the outer tube in order to have each inner diameter surface opening aligned with each opening in the outer tube. A plurality of helicoils are sized and shaped to be frictionally secured within the lock bold sleeves inner diameter surface. A plurality of lock bolts are sized and shaped to be frictionaly secure within the helicoils allowing for rotation of the lock bolts to cause motion of the lock bolt either inward toward or outward away from the point where the lock bolt sleeves are fixedly attached to the outer surface of the outer tube. The lock bolts have a contact end and an adjustment end.

An adjustment tube is sized and shaped to fit slideably within the first outer tube. The adjustment tube is of sufficient length in order that it extends within the first outer tube to a point beyond the openings.

The lock bolt is of sufficient length in order that the contact end protrudes through the opening in the outer tube and makes contact with the outer surface of the adjustment tube as the lock bolt is rotated causing inward movement. When sufficient torque is applied to the lock bolt causing further inward movement the contact end of the lock bolt is secured to the outer surface of the adjustment tube and prevents movement of the adjustment tube within the first outer tube.

By means of a plurality of extenders, support tubes and bolts, the device may easily be made of sufficient length to accommodate the shallow water depth near shore or the deeper water depth at the portion of the dock most distant from shore.

The most bottom support tube slides over and is secured by means of a bolt to a tube stub positioned on a base plate that rests on the bottom surface of the pond or lake.

The device is designed and manufactured to be stable and secure anticipating substantial weight being applied. However, in the event additional weight security is required, a safety clamp may be frictionally secured to the adjustment tube allowing the bottom end of the outer tube to rest on upper facing surface of the safety clamp.

The devise is further designed and manufactured to be environmentally safe by using non-corrosive materials thereby avoiding contamination of the water body involved.

BRIEF DESCRIPTION OF THE DRAWINGS

The features of the apparatus may be further illustrated by reference to the drawings appended hereto.

DESCRIPTION OF THE PREFERRED EMBODIMENT

Figure 1:
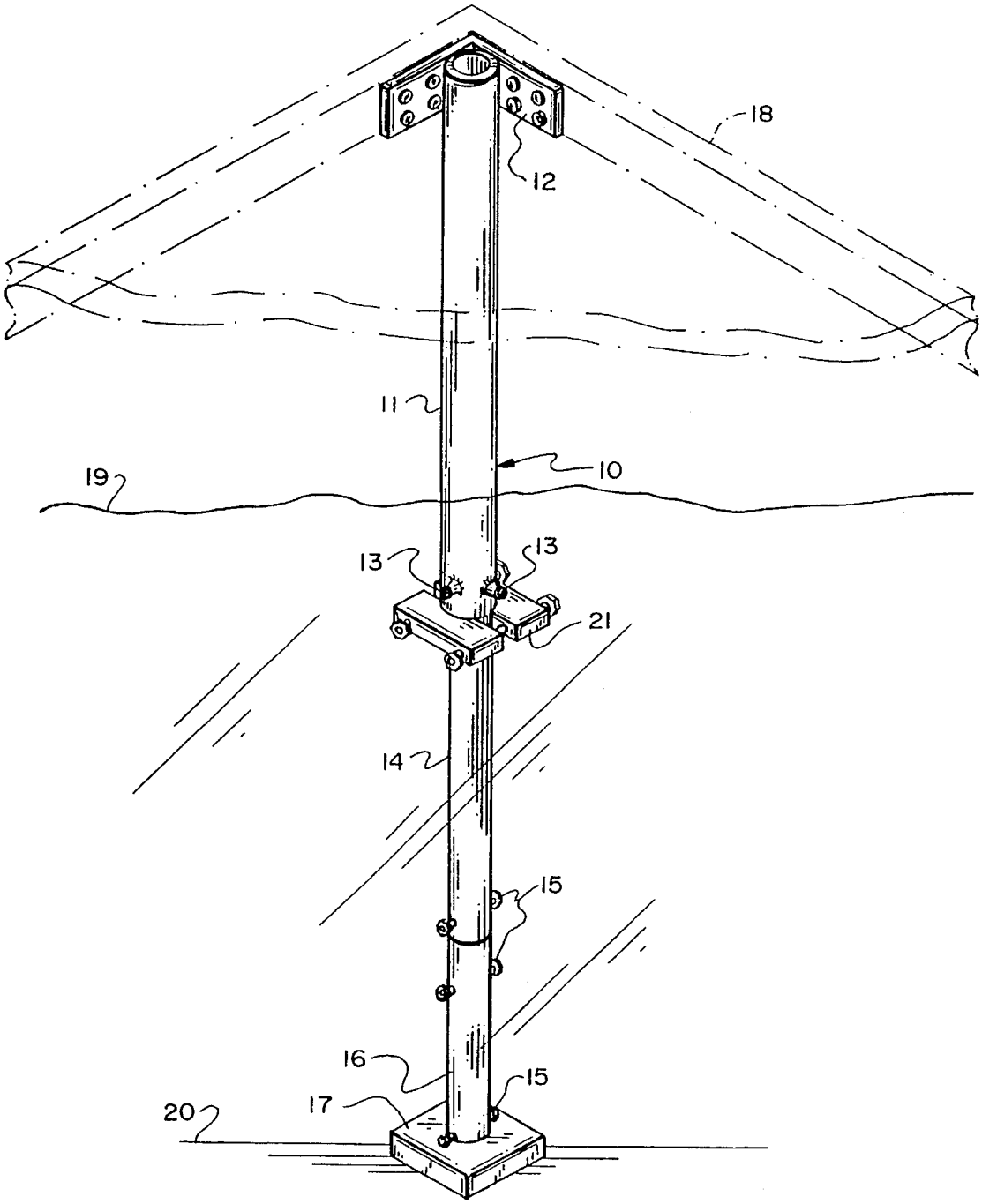
FIG. 1 shows a perspective view of the Adjustable Dock Support Apparatus indicated generally by reference number 10. The outer tube 11 with contact plate 12 is shown having lock bolt sleeves 13 fixedly secured thereto. Adjustment tube 14 is shown secured by bolt 15. Support tube 16 is shown secured by bolt 15. Base plate 17 is shown, the dock 18, water line 19 and bottom surface of the pond or lake 20 are shown for illustrative purposes. Also shown is the safety support clamp 21.
Figure 2:
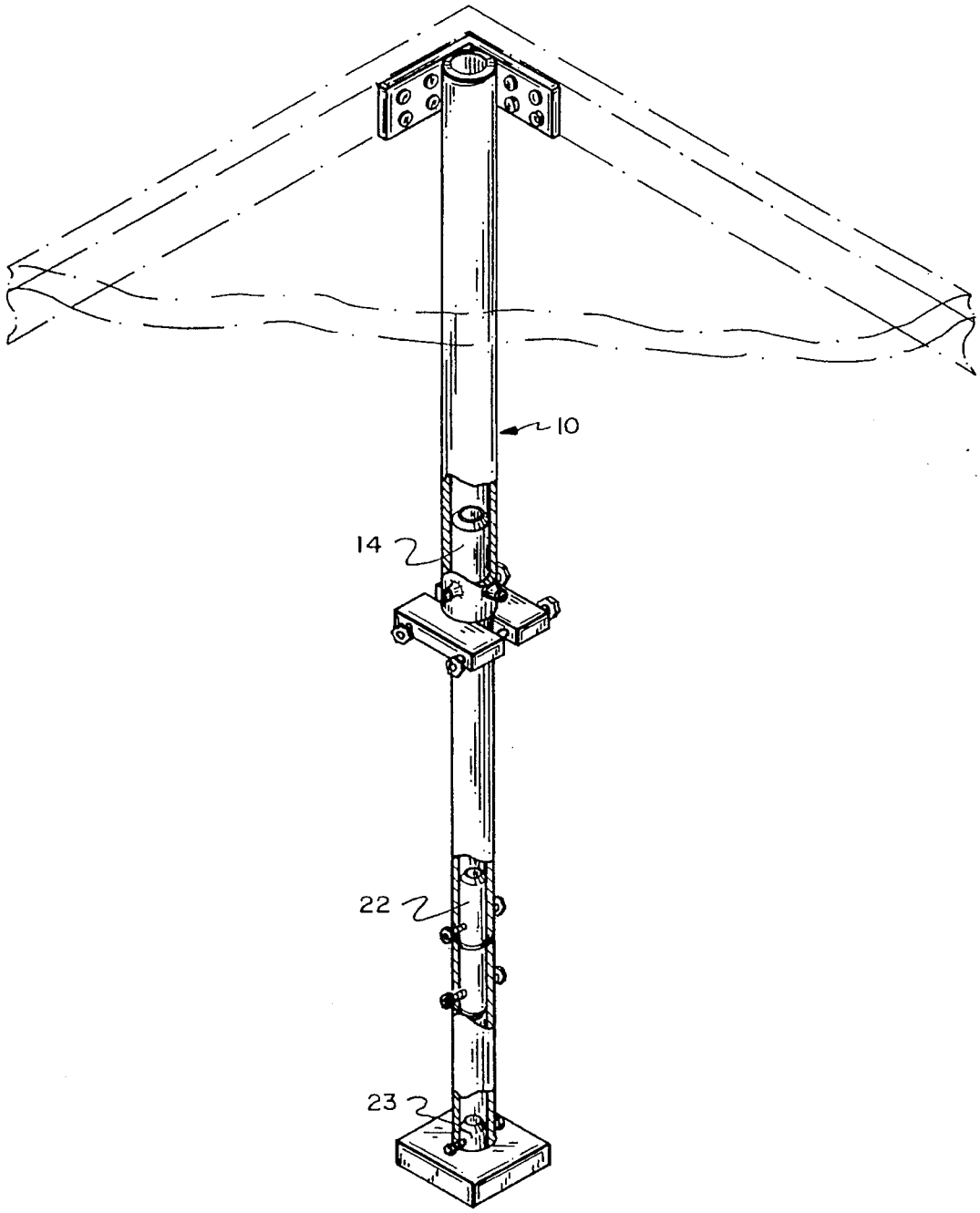
FIG. 2 shows the Adjustable Dock Support Apparatus 10 with cut away views to reveal the upper most end of the adjustment tube 14, the extender 22 and base plate tube stub 23.
Figure 3:
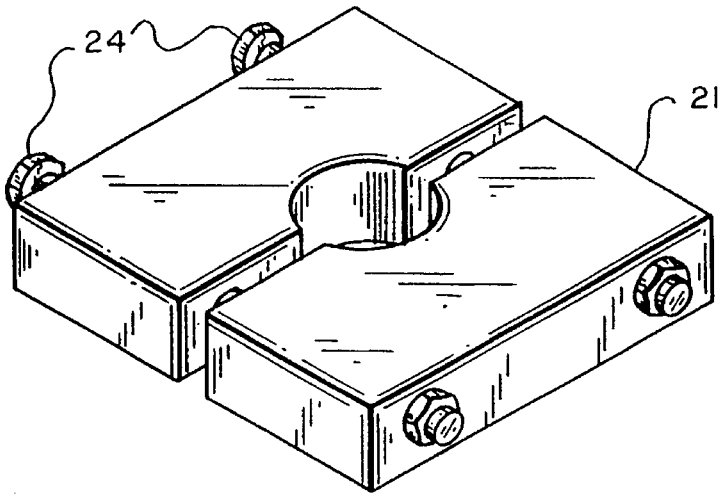
FIG. 3 shows the safety support clamp 21 showing the bolts 24 that are used to secure the safety support clamp 21 to the adjustment tube 14.
Figure 4:
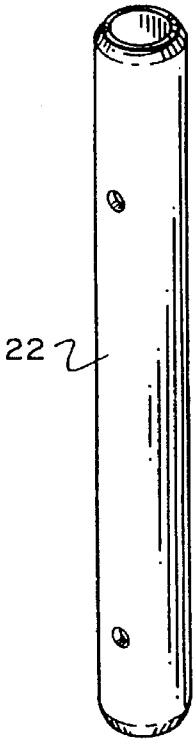
FIG. 4 illustrates the extender 22.
Figure 5:
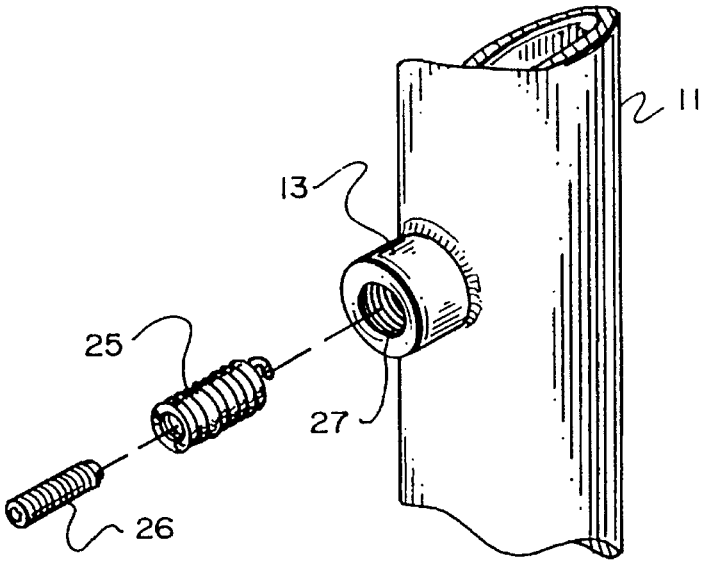
FIG. 5 illustrates the lock bolt sleeve 13 as fixedly secured to the outer tube 11. Also shown are the helicoil 25 and lock bolt 26. Also shown are the threads 27 on the inner surface of the lock bolt sleeve 13.

Turning first to FIG. 1., there is shown the ADJUSTABLE DOCK SUPPORT APPARATUS of the present invention shown generally by reference number 10. The apparatus comprises an outer tube 11 with contact plate 12 secured to a structural member of a dock 18. The outer tube has lock bolt sleeves 13 fixedly secured near the bottom end of the outer tube. An adjustment tube 14 is shown positioned within the bottom end of the outer tube as shown in the cut away view of FIG. 2. The adjustment tube 14 is secured to an extender 22 by means of bolt 15 as shown in FIG. 1. and the cut away view of FIG. 2. A support tube 16 is also secured to the extender 22 by means of a second bolt 15. In addition the support tube is secured to the base plate tube stub 23 by means of a third bolt 15. The base plate 17 is shown in FIG. 1 resting on the bottom surface of the lake or pond 20. The apparatus is initially assembled and the base plate 17 is positioned of the lake bottom 20 at the desired location then attached to the dock by securing the outer tube contact plate 12 to one of the dock support members 18. After a number of such apparatus have been positioned and secured the dock is raised to the desired height above the water's surface. Once the dock is determined to be nearly level the lock bolts 26 are rotated causing movement of the lock bolts through holes in the outer tube 11 toward the adjustment tubes 14. The lock bolts 26 are rotated until they are making secure contact with the outer diameter surface of the adjustment tubes 14. The torque applied to the lock bolts 26 is sufficient to secure the outer tubes 11 in relation to the adjustment tubes i4 thereby stabilizing the dock. Fine adjustment of the dock may be made by adjusting each apparatus thereby making the dock level and secure. The torque applied to the lock bolts is sufficient in order that the apparatus is capable of holding a great load safely. In the event there is concern regarding an extraordinary load being placed upon the dock it possible to add a safety support clamp 21. The safety support clamp is shown in use in both FIG. 1 and FIG. 2. and in detail in FIG. 3. The clamp is secured on the adjustment tube 14 in order that the most bottom end of the outer tube 11 rests firmly on the upper surface of the clamp. The clamp thereby acts to prevent the outer tube from moving downward in the event any of the lock bolts are not exerting sufficient resistive pressure against the adjustment tubes. Detail of the lock bolts 26, helicoil 25 and lock bolt sleeves 13 is shown in FIG. 5. The threaded interior 27 of the sleeve is also shown. The helicoil 25 is compressed slightly in order to fit securely within the sleeve.

From the foregoing description it will be apparent that modifications can be made to the apparatus without departing from the teaching of the present invention. Accordingly, it is distinctly understood that the invention is not limited to the preferred embodiment but may be embodied and practiced within the scope of the following claims.

I hereby claim the following:

1. Adjustable Dock Support Apparatus comprising:

(a) an outer tube with a contact end, a most bottom end, an outer surface, an inner surface forming one continuous tunnel with constant diameter running from the contact end to the most bottom end, said outer tube having a plurality of holes therein, (b) an adjustment tube having a top end, a bottom end, an outer diameter surface, an inner diameter surface forming a continuous tunnel with constant diameter running from the top end to the bottom end, the outer diameter surface being sized and shaped in order that said adjustment tube may slide freely within the inner surface of said outer tube, the adjustment tube having a plurality of holes therein, (c) a plurality of support tubes having a top end, a bottom end, an outer surface that has a diameter nearly equal to that of the outer diameter surface of said adjustment tube, and an inner surface forming a continuous tunnel with a constant diameter running from the top end to the bottom end, the support tubes having a plurality of holes therein, (d) a plurality of extenders cylindrical in shape having a constant outer diameter each having a plurality of holes therein, said extenders being sized and shaped to slide freely within the adjustment tube inner diameter surface and the support tubes inner surface, (e) a plurality of lock bolt sleeves having an outer surface, a threaded inner surface, said lock bolt sleeves being fixedly secured to the outer tube outer surface located in order that each lock bolt sleeve is centrally positioned over one of said holes in said outer tube, (f) a plurality of helicoils sized and shaped to fit upon compression securely within the threaded inner surface of the lock bolt sleeves, (g) a plurality of lock bolts sized and shaped to fit within the helieoils and move in an inward or outward direction upon being rotated within the helicoils, and further sized and shaped to pass through the holes in the outer tube and make secure contact with the outer diameter surface of the adjustment tube, (h) a base plate with a flat bottom surface, a top surface in the shape of a tube stub have a plurality of holes therein, said base plate tube stub being cylindrical in shape with a constant diameter and sized and shaped to fit within the inner surface of the support tube, (i) a plurality of support bolts each with threaded shafts including at least a first support bolt sized and shaped m pass freely through two of the holes in the adjustment tube and also through a hole in an extender positioned within the inner diameter surface of the adjustment tube further being of sufficient length to extend beyond the outer diameter surface of the adjustment tube, a second support bolt sized and shaped to pass freely through two of the holes in said support tubes and also through a hole in an extender positioned within the inner surface of the support tube being of sufficient length to extend beyond the outer surface of the support tube, and a third support bolt with threaded shaft sized and shaped to pass freely through two of the holes in one of said support tubes and also through a hole in said base plate tube stub positioned within the inner surface of the support tube being of sufficient length to extend beyond the outer surface of the support tube, and (j) a plurality of support nuts sized and shaped to be frictionally secured upon the threaded shafts of said support bolts and further to secure the extenders and base plate tube stub within the support tubes, and the extender within the adjustment tube.

2. Apparatus as recited in claim 1, wherein a safety support clamp with an upper surface and a bottom surface is secured by pressure and friction to the outer diameter surface of the adjustment tube at a point in order that the most bottom end of said outer tube makes contact with the upper surface of said safety support clamp.

3. Method for supporting a Dock by means of an Adjustable Dock Support Apparatus comprising the steps of:

(a) positioning a dock at a desired location on a lakes water surface, (b) assembling an Adjustable Dock Support means being;

(i) an outer tube with a contact end, a most bottom end, an outer surface, an inner surface forming one continuous tunnel with constant diameter running from the contact end to the most bottom end, said outer tube having a plurality of holes therein, (ii) an adjustment tube having a top end, a bottom end, an outer diameter surface, an inner diameter surface forming a continuous tunnel with constant diameter running from the top end to the bottom end, the outer diameter surface being sized and shaped in order that said adjustment tube may slide freely within the inner surface of said outer tube, the adjustment tube having a plurality of holes therein, (iii) a plurality of support tubes having a top end, a bottom end, an outer surface that has a diameter nearly equal to that of the outer diameter surface of said adjustment tube, and an inner surface forming a continuous tunnel with a constant diameter running from the top end to the bottom end, the support tubes having a plurality of holes therein, (iv) a plurality of extenders cylindrical in shape having a constant outer diameter each having a plurality of holes therein, said extenders being sized and shaped to slide freely within the adjustment tube inner diameter surface and the support tubes inner surface, (v) a plurality of lock bolt sleeves having an outer surface, a threaded inner surface, said lock bolt sleeves being fixedly secured to the outer tube outer surface located in order that each lock bolt sleeve is centrally positioned over one of said holes in said outer tube, (vi) a plurality of helicoils sized and shaped to fit upon compression securely within the threaded inner surface of the lock bolt sleeves, (vii) a plurality of lock bolts sized and shaped to fit within the helicoils and move in an inward or outward direction upon being rotated within the helicoils, and further sized and shaped to pass through the holes in the outer tube and make secure contact with the outer diameter surface of the adjustment tube, (viii) a base plate with a flat bottom surface, a top surface in the shape of a tube stub have a plurality of holes therein, said base plate tube stub being cylindrical in shape with a constant diameter and sized and shaped to fit within the inner surface of the support tube, (ix) a plurality of support bolts each with threaded shafts including at least a first support bolt sized and shaped to pass freely through two of the holes in the adjustment tube and also through a hole in an extender positioned within the inner diameter surface of the adjustment tube further being of sufficient length to extend beyond the outer diameter surface of the adjustment tube, a second support bolt sized and shaped to pass freely through two of the holes in said support tubes and also through a hole in an extender positioned within the inner surface of the support tube being of sufficient length to extend beyond the outer surface of the support tube, and a third support bolt with threaded shaft sized and shaped to pass freely through two of the holes in one of said support tubes and also through a hole in said base plate tube stub positioned within the inner surface of the support tube being of sufficient length to extend beyond the outer surface of the support tube, and (x) a plurality of support nuts sized and shaped to be frictionally secured upon the threaded shafts of said support bolts and further to secure the extenders and base plate tube stub within the support tubes, and the extender within the adjustment tube, (c) positioning the base plate on the bottom on the lake at a desired location, (d) securing the contact end of the outer tube to said dock, (e) repeating steps (b) through (d) for the number of Adjustable Dock Support means required, (f) raising the dock a desired distance above the lakes water surface, and (g) rotating the lock bolts in order that the lock bolts make secure contact with the outer diameter surface of each adjustment tube.

4. A method as described in claim 3, including the additional step of securing a safety support clamp means being a safety support clamp with an upper surface and a bottom surface that is secured by pressure and friction to the outer diameter surface of the adjustment tube at a point in order that the most bottom end of said outer tube makes contact with the upper surface of said safety support clamp.

* * * * *